US006881292B2

(12) United States Patent
Chen

(10) Patent No.: US 6,881,292 B2
(45) Date of Patent: Apr. 19, 2005

(54) GOLF CLUB HEAD AND MANUFACTURING METHOD THEREFOR

(75) Inventor: Yun-Fang Chen, Taoyuan Hsien (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 47 days.

(21) Appl. No.: 10/379,705

(22) Filed: Mar. 6, 2003

(65) Prior Publication Data

US 2004/0157680 A1 Aug. 12, 2004

(51) Int. Cl.[7] ..... B32B 31/04; B29C 65/70; A63B 53/04

(52) U.S. Cl. ..... 156/293; 264/257; 264/259; 264/313; 473/324; 473/346; 473/347

(58) Field of Search ..... 156/156, 293, 156/295; 264/257, 258, 259, 313; 473/324, 334, 335, 338, 339, 345, 346

(56) References Cited

U.S. PATENT DOCUMENTS 5,350,556 A * 9/1994 Abe et al. ..... 264/248
2001/0049310 A1 * 12/2001 Cheng et al. ..... 473/334
2002/0160858 A1 * 10/2002 Lee ..... 473/345

FOREIGN PATENT DOCUMENTS

JP 7-213655 * 8/1995

* cited by examiner

*Primary Examiner*—Blaine Copenheaver
*Assistant Examiner*—Justin Fischer
(74) *Attorney, Agent, or Firm*—Bacon & Thomas

(57) ABSTRACT

A manufacturing method for a golf club head comprises steps of: forming a plurality of through holes and annular recessed flanges thereof on a crown plate, a sole plate and a side plate of a main body blank; preparing a plurality of carbon-fiber plates by carbon-fiber fabrics; inserting a plurality of carbon-fiber reinforcing members and an air-inflating bag into the main body blank; adhering the carbon-fiber plates to the corresponding annular recessed flanges; inserting the main body blank into a die assembly and then injecting air into the air-inflating bag to thereby support the carbon-fiber plates and the reinforcing members; drawing out the flat air-inflating bag and precise processing the finished main body to accomplish an end product.

10 Claims, 6 Drawing Sheets

GOLF CLUB HEAD AND MANUFACTURING METHOD THEREFOR

BACKGROUND OF THE INVENTION

1. Field of the Invention

The present invention is related to a golf club head and a manufacturing method therefor. More particularly, the present invention is related to a main body of the golf club head comprising a plurality of carbon-fiber plates, which is adapted to substitute partial metal portions of the main body to thereby adjusting a center of gravity, weight, striking sound, and design choice.

2. Description of the Related Art

A conventional golf club head mainly includes a main body and a striking plate attached thereto, all of which are made of metal or alloy. The main body is formed as a single member by casting or consisted of a crown plate, a sole plate and a side plate by welding. As to the striking plate, it is attached to a front surface of the main body by incorporating, welding or embedding. To meet various requirements, manufacture may change the configuration and the structural connection of the main body and the striking plate to lower its center of gravity and its total weight. Since the main body is made of metal, the center of gravity and the total weight of the main body cannot be effectively adjusted specific.

An another conventional golf club head mainly includes a metal main body formed with an opening at its top and regarded as a filling portion. Plurality of prepared carbon-fiber fabrics are piled up and used for attaching to the opening of the main body and sealing it. The prepared carbon-fiber fabrics have plasticity before heating and hardening it. Firstly, the main body is placed in a die assembly and an air-inflating bag is used to support the prepared carbon-fiber fabrics on the main body so that the main body can be formed with a carbon-fiber portion. Light material of the carbon-fiber portion may cause reduction of weight and thus the center of gravity and the total weight of the main body can be adjusted specific. By manufacture such a large carbon-fiber portion, it is sophisticated the manufacture processes of the prepared carbon-fiber fabrics and prolonged the manufacture time. In manufacture operation, it is reduced the product quality due to irregular deformation of the prepared carbon-fiber fabrics. Moreover, a large area of the prepared carbon-fiber fabrics may weaken the entire structural strength of the main body and it may lower its striking sound instead of a sharp striking sound making by a metal golf club head.

The present invention intends to provide a golf club head and a manufacturing method therefor, which comprises a plurality of carbon-fiber plates and a plurality of weights that is able to adjust a center of gravity and weight. Moreover, the present invention utilizes a plurality of reinforcing members for the carbon-fiber plates that is able to strengthen entire structure and to enhance a striking sound in such a way to mitigate and overcome the above problem.

SUMMARY OF THE INVENTION

The primary objective of this invention is to provide a golf club head and a manufacturing method therefor, which utilizes carbon-fiber plates substituting for metal portions of the golf club head to adjust a center of gravity and weight, thereby increasing striking performance.

The secondary objective of this invention is to provide the golf club head and the manufacturing method therefor, which is provided with annular recessed flanges in place for mounting carbon-fiber plates. Thereby the golf club head is able to adjust amount of weight pieces, dimensions, and total weight.

An another objective of this invention is to provide the golf club head and the manufacturing method therefor, which forms a plurality of prepared carbon-fiber plates prior to combining with associated annular recessed flanges that may speed up assemble process and increase product quality.

An another objective of this invention is to provide the golf club head and the manufacturing method therefor, which reserves an adequate metal portion of the golf club head in addition to carbon-fiber plates that may make a sharp striking sound.

An another objective of this invention is to provide the golf club head and the manufacturing method therefor, which employs for reinforcing members to insure assembled relationship of carbon-fiber plates and the golf club head that increases a structural strength of the golf club head.

The manufacturing method for the golf club head in accordance with the present invention comprises steps of: forming a plurality of through holes and annular recessed flanges thereof on a crown plate, a sole plate and a side plate of a main body blank; preparing a plurality of carbon-fiber plates by carbon-fiber fabrics; inserting a plurality of carbon-fiber reinforcing members and an air-inflating bag into the main body blank; adhering the carbon-fiber plates to the corresponding annular recessed flanges; inserting the main body blank into a die assembly and then injecting air into the air-inflating bag to thereby support the carbon-fiber plates and the reinforcing members; drawing out the flat air-inflating bag and precise processing the finished main body to accomplish an end product.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
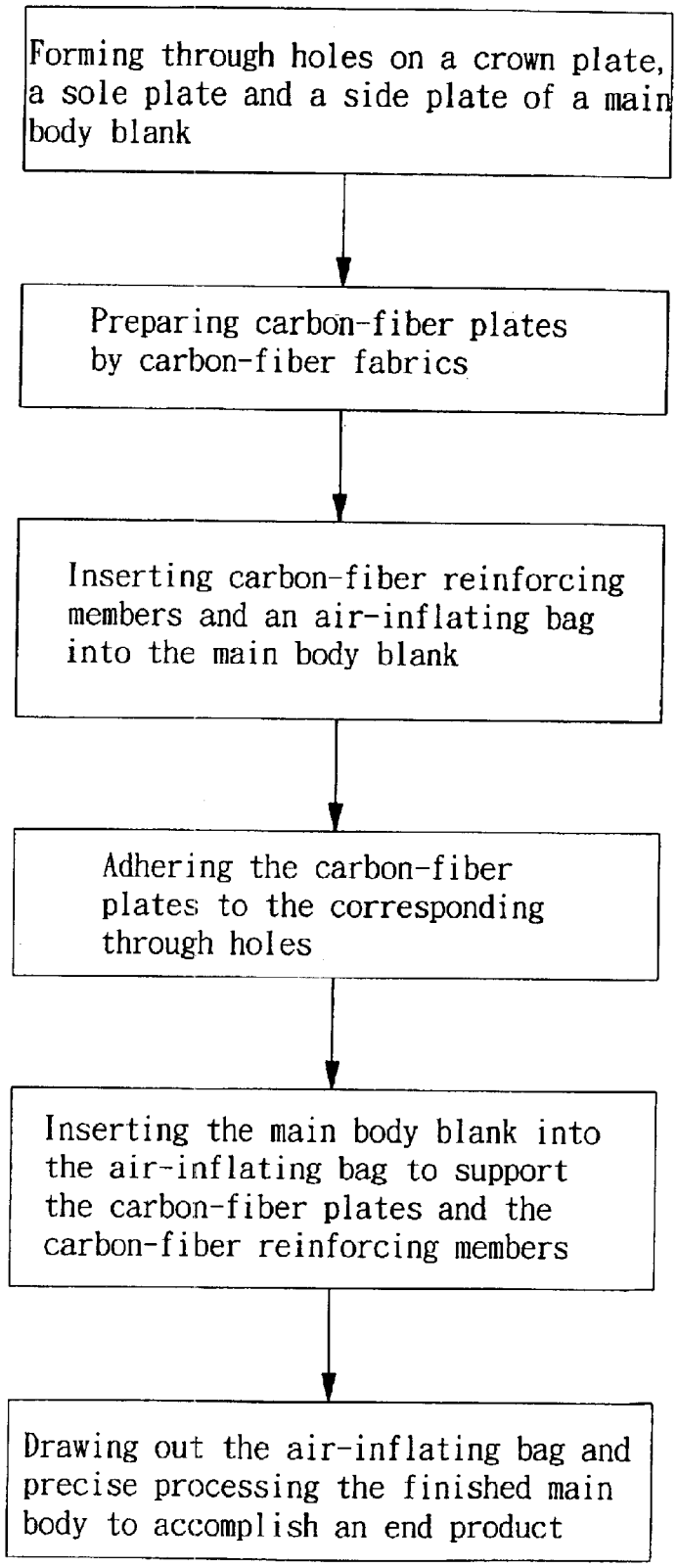
FIG. 1 is a block diagram of a golf club head and a manufacturing method therefor in accordance with the present invention.

Referring to FIG. 1 through 5, a manufacturing method for a golf club head 1 in accordance with the present invention comprises a first step that forms a plurality of through holes 12, 13, 14 and 15 on a crown plate, a sole plate and a side plate of a main body blank 10. Preferably, the main body blank 10 is cast as a single member and made of material selecting from steel, titanium alloy, soft steel which are specific hardness material of metal or alloy. A front surface of the main body blank 10 is connected to a striking plate 11 by welding manner, integrating manner or embedding manner. The golf club head 1 includes a plurality of through holes 12, 13, 14 and 15, and annular recessed flanges 121, 131, 141 and 151 formed therein. The annular recessed flanges 121, 131, 141 and 151 are adapted to receive predetermined sizes of a carbon-fiber crown plate 21, a carbon-fiber sole plate 22, a weight 23 and an sealing plate 24.

To fix the weight 23, the through hole 14 is projected inward an annular wall 142. The sealing plate 24 is marked with characters and patterns on its outer surface and preferably made of aluminum alloy or carbon fiber that may reduce entire weight.

Figure 2:
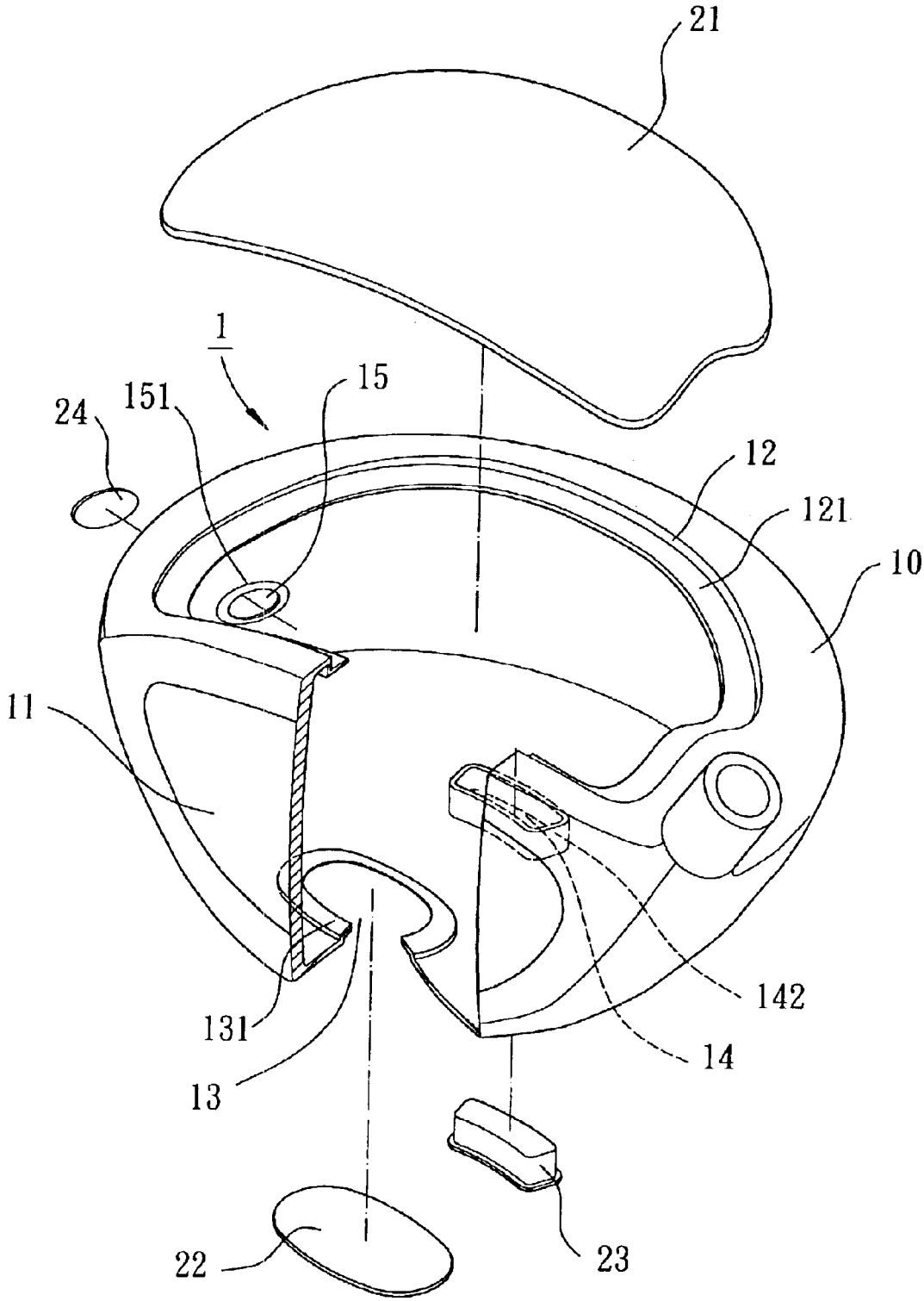
FIG. 2 is an exploded perspective view of the golf club head in accordance with an embodiment of the present invention.
Figure 4:
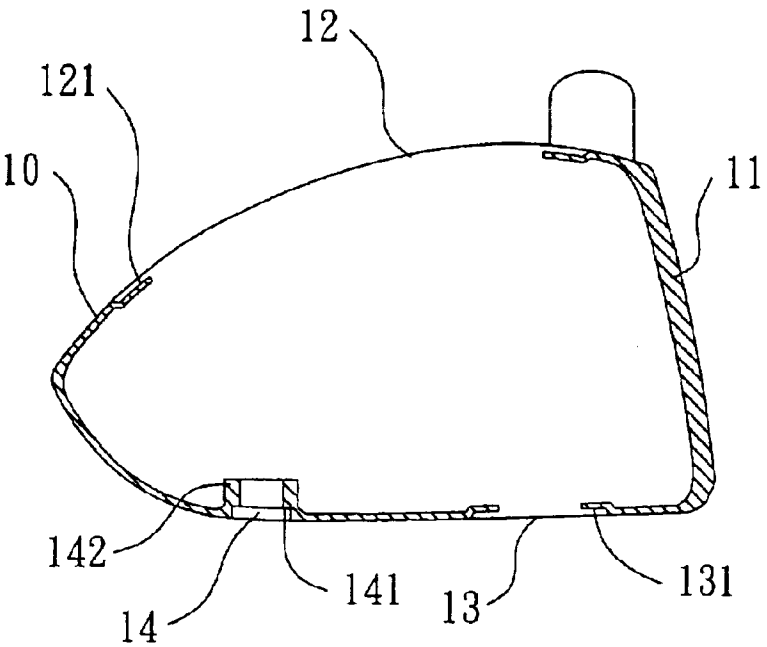
FIG. 4 is a cross-sectional view, taken along line 4—4 in FIG. 3, of the golf club head in accordance with the embodiment of the present invention.
Figure 3:
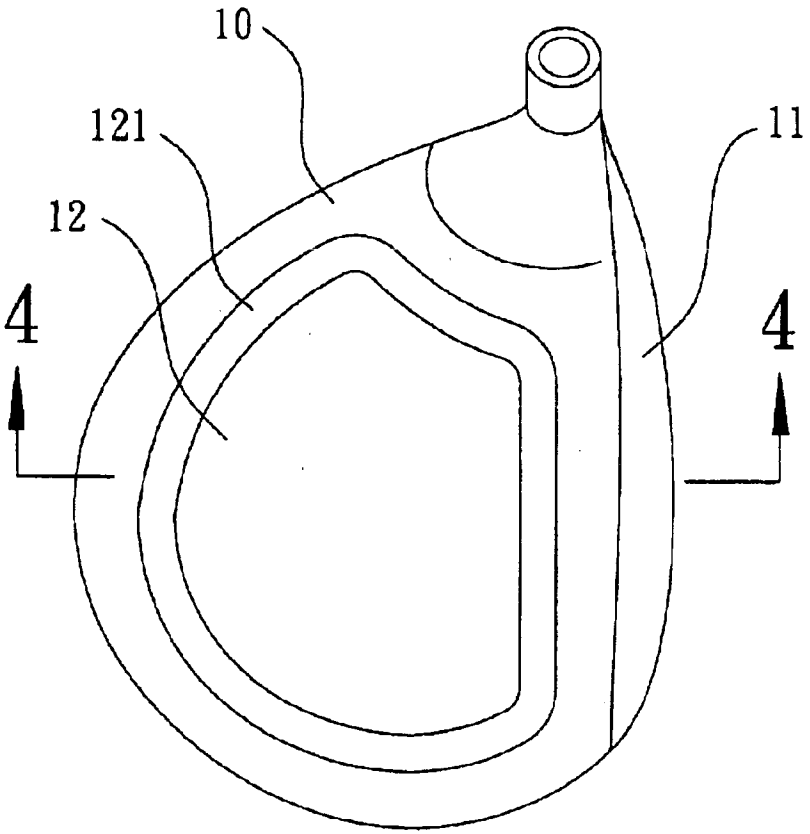
FIG. 3 is a top view of a main body of the golf club head in accordance with the embodiment of the present invention.
Figure 6:
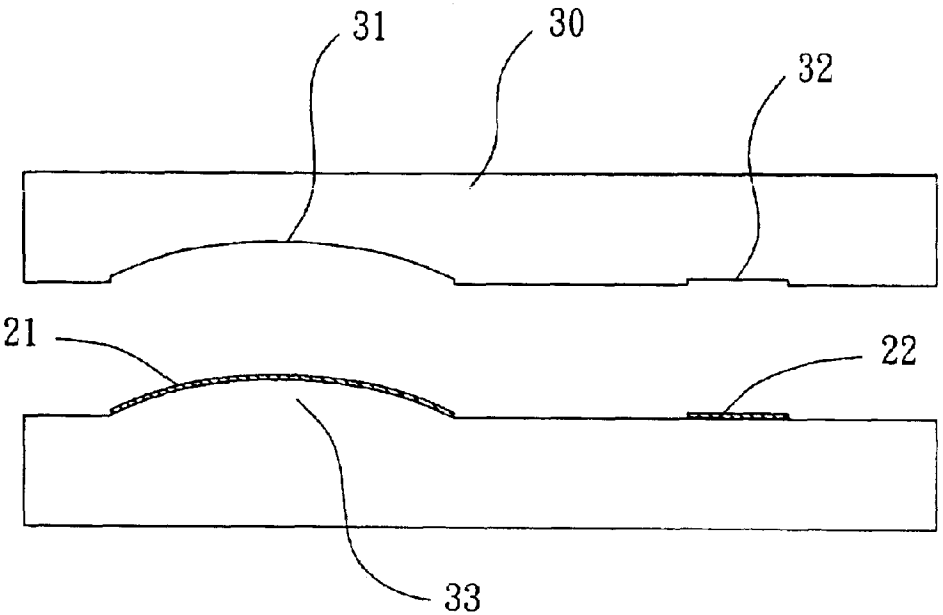
FIG. 6 is a schematic view of treating a carbon-fiber crown plate and a carbon-fiber sole plate in a die assembly in accordance with the embodiment of the present invention.
Figure 5:
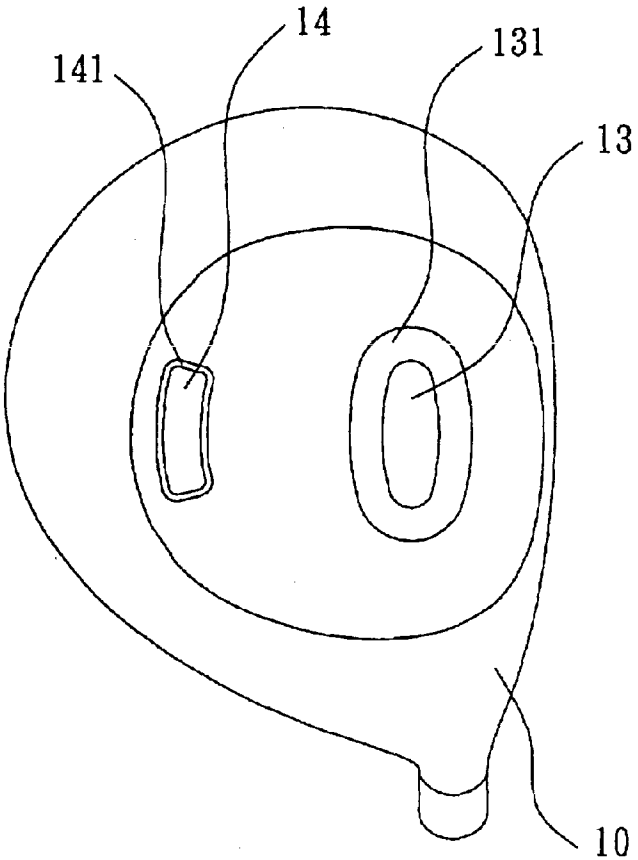
FIG. 5 is a bottom view of the main body of the golf club head in accordance with the embodiment of the present invention.

Referring to FIGS. 1, 2 and 6, the manufacturing method for the golf club head 1 in accordance with the present invention comprises a second step that prepares carbon-fiber plates 21 and 22 made of prepared carbon-fiber fabrics. To speed up following processes and increase product quality, the inventive method prepares appropriate the carbon-fiber crown plates 21, the carbon-fiber sole plates 22 or a side carbon-fiber plates (not shown) in amount, configurations and sizes.

As shown in FIG. 6, a die assembly 30 is employed for preparing the carbon-fiber plates 21 and 22, and provided predetermined recessions (female dies) 31, 32 and predetermined protrusions (male dies) 33 with predetermined configurations. In preparing operation, a plurality of carbon-fiber fabric sheets, preferably 4 through 10 layers, are interlaced in a preferred included angle of 0 degrees, 45 degrees, 90 degrees, and −45 degrees, and piled up each other. In hardening heat-treatment, a heater (not shown) heats the carbon-fiber fabric sheets at 130 degrees Centigrade 20 minutes subsequent to the die assembly 30 sandwiching it. After the carbon-fiber fabric sheets are hardened, the carbon-fiber crown plate 21 and the carbon-fiber sole plate are formed with predetermined dimensions.

According to design choice, the main body blank 10 of the golf club head 1 can be adjusted its center of gravity and its weight by presetting the through holes 12–15, the carbon-fiber crown plates 21 and the carbon-fiber sole plates 22 in amount and dimensions, and changing various weight 23. To make sharp striking sound, the golf club head 1 reserves adequate metal portions in addition to the carbon-fiber plates.

Figure 7:
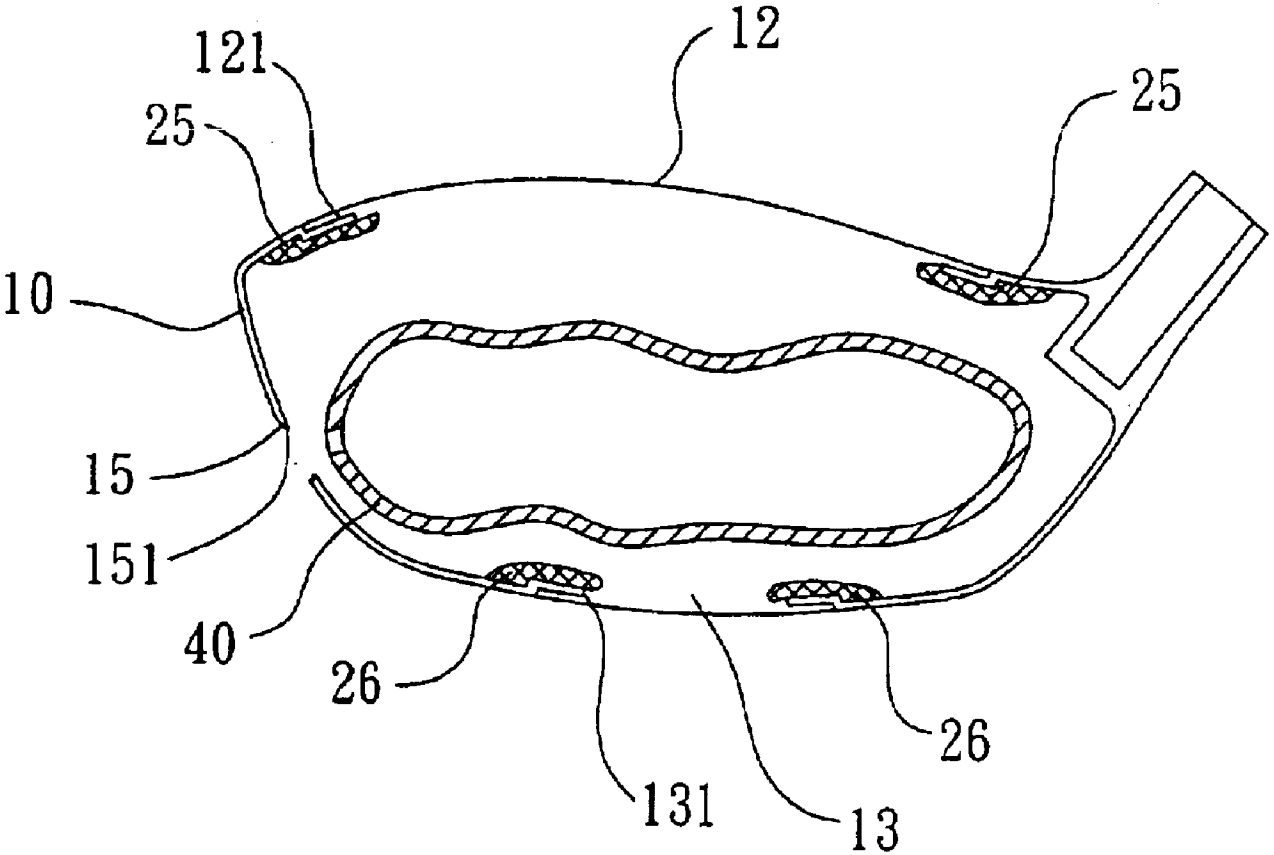
FIG. 7 is a cross-sectional view of inserting carbon-fiber reinforcing members and an air-inflating bag into a main body blank in accordance with the embodiment of the present invention.
Figure 9:
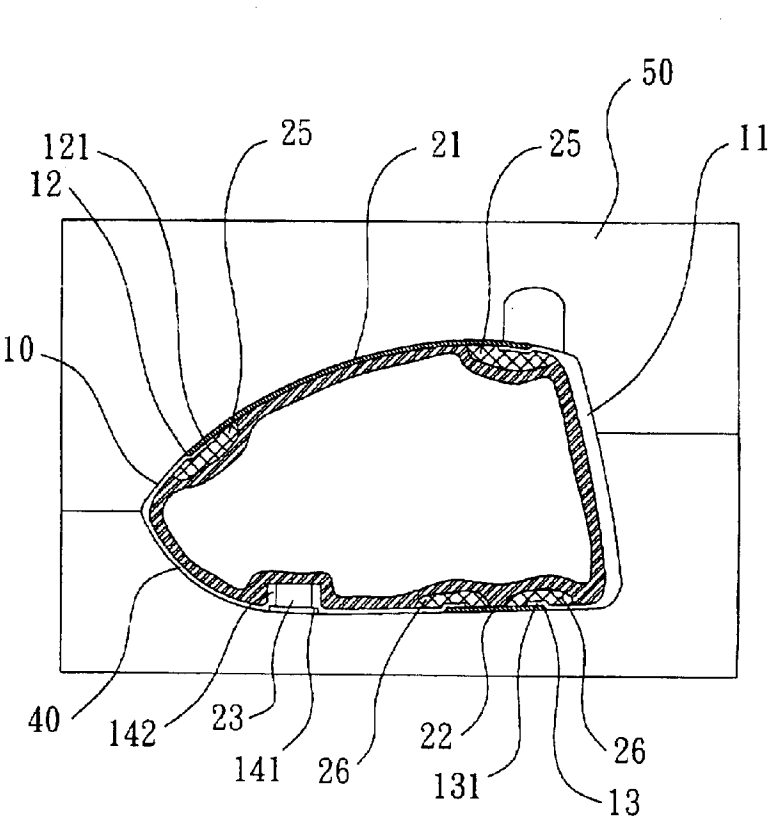
FIG. 9 is an another cross-sectional view of injecting air into the air-inflating bag in the main body blank placed in a die assembly in accordance with the embodiment of the present invention.
Figure 8:
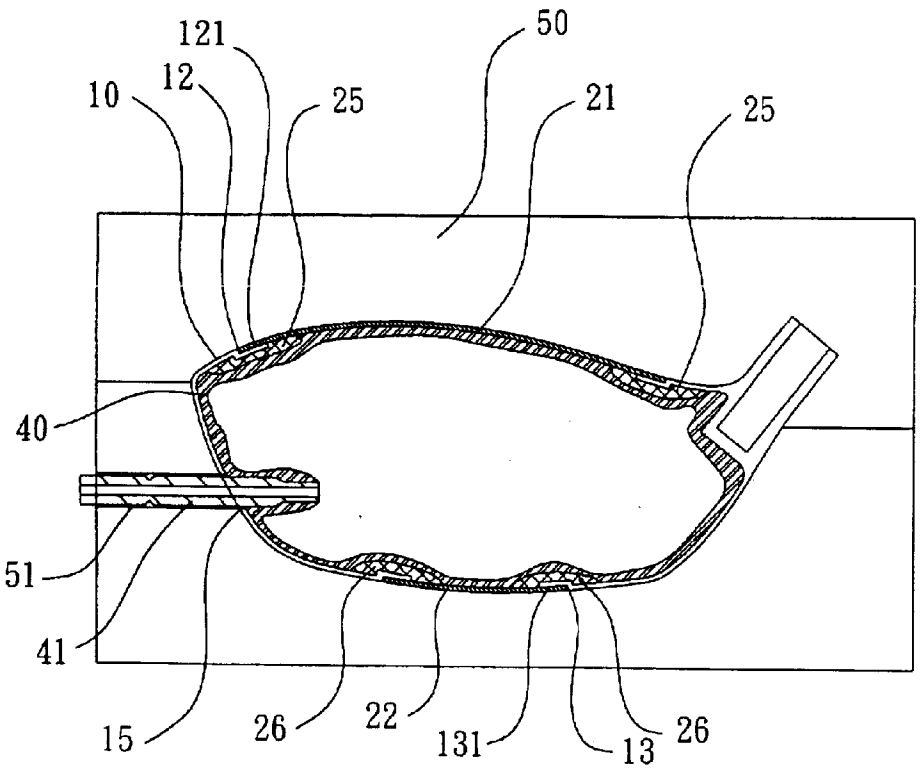
FIG. 8 is a cross-sectional view of injecting air into the air-inflating bag in the main body blank placed in a die assembly in accordance with the embodiment of the present invention.

Referring to FIGS. 1, 2 and 7, the manufacturing method for the golf club head 1 in accordance with the present invention comprises a third step that inserts a plurality of carbon-fiber reinforcing members 25, 26 and an air-inflating bag 40 into the main body blank 10. In the following process, the carbon-fiber crown plate 21 and the carbon-fiber sole plate 22 are incorporated into the through holes 12, 13 and adhered to the annular recessed flanges 121, 131. To strengthen such adhesion of the carbon-fiber plates 21, 22 to the through holes 12, 13, the carbon-fiber reinforcing members 25, 26 connects inner surfaces of the carbon-fiber plates 21, 22 to inner surfaces of the annular recessed flanges 121, 131. Preferably, the carbon-fiber reinforcing members 25, 26 are consisted of ring carbon-fiber sheets, which are interlaced and piled up each other. The carbon-fiber reinforcing members 25, 26 are adhered to the inner surfaces of the annular recessed flanges 121, 131 by self-adhesion or epoxy before hardening. So then inner peripheral edges of the carbon-fiber reinforcing members 25, 26 are projected from annular recessed flanges 121, 131 and connected with the carbon-fiber plates 21, 22 while outer peripheral edges of the carbon-fiber reinforcing members 25, 26 hiding under the annular recessed flanges 121, 131. Meanwhile, the air-inflating bag 40 is expanded to support the carbon-fiber plates 21, 22 and the carbon-fiber reinforcing members 25, 26.

Referring to FIGS. 1, 2, 7 and 8, the manufacturing method for the golf club head 1 in accordance with the present invention comprises a fourth step that adheres the carbon-fiber plates 21, 22 to the corresponding through holes 12, 13 of the main body blank 10 by means of adhesive, such as epoxy. And thus it is an initial connection of the carbon-fiber plates 21, 22 to the annular recessed flanges 121, 131 and carbon-fiber reinforcing members 25, 26. Similarly, the weight 23 is adhered to the through hole 14 by adhesive.

Referring to FIGS. 1, 2, 7 and 8, the manufacturing method for the golf club head 1 in accordance with the present invention comprises a fifth step that the main body blank 10 is placed in a die assembly 50. The air-inflating bag 40 are expanded to support the carbon-fiber plates 21, 22 and carbon-fiber reinforcing members 25, 26 subsequent to the main body blank 10 combining with the components 21, 22, 23, 25 and 26. The die assembly 50 includes an inner recession (not labeled) having an identical inner configuration with an outer configuration of the golf club head 1. Containing the main body blank 10, the die assembly 50 intimately contact with the outer surfaces of the main body blank 10 and the components 21, 22, 23, 25 and 26. The die assembly 50 further includes an opening 51 adapted to connect with the inner recession and to align with the through hole 15 of the main body blank 10 when it is contained in the inner recession. In operation, an air pipe 41 is passed through the opening 51 and connected with the air-inflating bag 40. When air pressure 3–7 kg/cm$^2$ injects into the air-inflating bag 40, it can expand and support the components 21, 22, 23, 25 and 26. Subsequently, a heater heats the die assembly 50 at 130 degrees Centigrade 20 minutes so that the carbon-fiber reinforcing members 25, 26 are heated and hardened to thereby connect with the main body blank 10 firmly, and a finished main body of the golf club head 1 is formed.

Referring to FIGS. 1, 2, 7 and, the manufacturing method for the golf club head 1 in accordance with the present invention comprises a sixth step that draws out the air-inflating bag 40 from the golf club head 1 for finishing process. When the main body blank 10 is firmly connected with the components 21, 22, 23, 25 and 26, the air pipe 41 is allowed to draw out from the opening 51. After releasing air, the air-inflating bag 40 is able to draw out from the die assembly 50 by means of clamping means. As best shown in FIG. 1, the through hole 15 is sealed by the sealing member 24 whose outer surface is provided with characters and patterns. Subsequently, the finished main body of the golf club head 1 is precise machining to eliminate its burr and then coating/lacquering to enhance its appearance. After processing above steps, the golf club head 1 of the present invention accomplishes lowering a center of gravity and weight, and making a sharp striking sound.

Referring again to FIG. 2, the manufacturing method for the golf club head 1 in accordance with the present invention reserves adequate metal portions of the main body 10, which is able to make a sharp striking sound, relative to the through holes 12, 13, 14. Furthermore, the through holes 12, 13, 14 are adapted to contain the carbon-fiber plates 21, 22 and the weight 23 for lowering a center of gravity and weight. Meanwhile, the inventive golf club head 1 further employs the carbon-fiber reinforcing members 25, 26 to strength the connected relationship between the main body 10 and the components 21, 22. As to the conventional golf club head, it is unable to effectively adjust a center of gravity and weight, to speed up preparing carbon-fiber plates, to increase product quality, and to make a sharp striking sound.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A manufacturing method for a golf club head, comprising steps of:

forming a plurality of through holes on a crown plate, a sole plate and a side plate of a main body blank;

preparing a plurality of carbon-fiber plates by carbon-fiber fabrics;

inserting a plurality of carbon-fiber reinforcing members and an air-inflating bag into the main body blank;

adhering the carbon-fiber plates to the corresponding through holes;

inserting the main body blank into a first die assembly and then expanding the air-inflating bag to thereby support the carbon-fiber plates and the reinforcing members; and drawing out the flat air-inflating bag and precise processing the finished main body to accomplish an end product.

2. The manufacturing method as defined in claim 1, wherein the carbon-fiber plates includes a carbon-fiber crown plate, a carbon-fiber sole plate, and a carbon-fiber side plate.

3. The manufacturing method as defined in claim 1, wherein each of the carbon-fiber plates is consisted of a plurality of carbon-fiber fabric sheets, which are interlaced and piled up each other in a second die assembly.

4. The manufacturing method as defined in claim 1, wherein the carbon-fiber plates are adhered to the through holes by epoxy.

5. The manufacturing method as defined in claim 1, wherein the through holes are formed with annular recessed flanges adapted to connected with the carbon-fiber plates.

6. The manufacturing method as defined in claim 5, wherein the carbon-fiber reinforcing members are consisted of ring carbon-fiber sheets, which are interlaced and piled up each other; the carbon-fiber reinforcing members are adapted to adhere to an inner surface of the annular recessed flanges.

7. The manufacturing method as defined in claim 1 further comprising a weight adhered to one of the through holes provided on a bottom of the main body blank.

8. The manufacturing method as defined in claim 1 further comprising an opening formed on the first die assembly aligned with one of the through holes; when the air-inflating bag is inserted into the first die assembly, the opening allows passage of an air pipe connecting to the air-inflating bag.

9. The manufacturing method as defined in claim 8 further comprising a sealing plate adapted to seal said through hole, the sealing plate including an outer surface on which to provide with characters and patterns.

10. The manufacturing method as defined in claim 1 further comprising a step of hardening the carbon-fiber reinforcing members subsequent to the air-inflating bag is expanding to support the carbon-fiber plates and the carbon-fiber reinforcing members.

* * * * *